US010978769B2

(12) United States Patent
Olivadese et al.

(10) Patent No.: US 10,978,769 B2
(45) **Date of Patent: *Apr. 13, 2021**

(54) WELL THERMALIZED STRIPLINE FORMATION FOR HIGH-DENSITY CONNECTIONS IN QUANTUM APPLICATIONS

(71) Applicant: International Business Machines Corporation, Armonk, NY (US)

(72) Inventors: Salvatore B. Olivadese, Stamford, CT (US); Patryk Gumann, Tarrytown, NY (US); Jerry M. Chow, White Plains, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/908,009

(22) Filed: Jun. 22, 2020

(65) Prior Publication Data

US 2020/0321675 A1 Oct. 8, 2020

Related U.S. Application Data

(63) Continuation of application No. 16/124,984, filed on Sep. 7, 2018.

(51) Int. Cl.

| | |
|---|---|
| ***H01P 3/08*** | (2006.01) |
| ***H01P 5/08*** | (2006.01) |
| ***H01P 11/00*** | (2006.01) |
| ***H01P 1/30*** | (2006.01) |

(52) U.S. Cl.

CPC ..... *H01P 3/08* (2013.01); *H01P 1/30* (2013.01); *H01P 3/085* (2013.01); *H01P 5/085* (2013.01); *H01P 11/003* (2013.01)

(58) Field of Classification Search

CPC ..... H01P 3/08; H01P 11/003; H01P 3/081; H01P 3/082; H01P 3/084; H01P 3/085; H01P 3/087; H01P 5/085

USPC ..... 333/236, 238, 246, 4, 5, 33, 156, 161, 333/99 S

See application file for complete search history.

(56) References Cited

U.S. PATENT DOCUMENTS 10,453,592 B1 * 10/2019 Smith ..... H01B 12/16

OTHER PUBLICATIONS

McGarey et al. "A 16 Channel Flex Circuit for Cryogenic Microwave Signal Transmission), 2014," Millimeter , Submillimeter and Far-Infrared Detectors and Instrumentations for Astronomy VIII (Year: 2014).*

List of all related IBM dockets, 2020.

* cited by examiner

*Primary Examiner* — Rakesh B Patel

*Assistant Examiner* — Jorge L Salazar, Jr.

(74) *Attorney, Agent, or Firm* — Garg Law Firm, PLLC; Rakesh Garg; Keivan Razavi

(57) ABSTRACT

A stripline that is usable in a quantum application (q-stripline) includes a first polyimide film and a second polyimide film. The q-stripline further includes a first center conductor and a second center conductor formed between the first polyimide film and the second polyimide film. The q-stripline has a first pin configured through the second polyimide film to make electrical and thermal contact with the first center conductor.

20 Claims, 7 Drawing Sheets

WELL THERMALIZED STRIPLINE FORMATION FOR HIGH-DENSITY CONNECTIONS IN QUANTUM APPLICATIONS

TECHNICAL FIELD

The present invention relates generally to a device, a fabrication method, and fabrication system for forming electrical and thermal connections with superconducting qubits in a quantum computing environment. More particularly, the present invention relates to a device, method, and system for well-thermalized stripline formation for high-density connections in quantum applications.

BACKGROUND

Hereinafter, a "Q" prefix in a word of phrase is indicative of a reference of that word or phrase in a quantum computing context unless expressly distinguished where used.

Molecules and subatomic particles follow the laws of quantum mechanics, a branch of physics that explores how the physical world works at the most fundamental levels. At this level, particles behave in strange ways, taking on more than one state at the same time, and interacting with other particles that are very far away. Quantum computing harnesses these quantum phenomena to process information.

The computers we use today are known as classical computers (also referred to herein as "conventional" computers or conventional nodes, or "CN"). A conventional computer uses a conventional processor fabricated using semiconductor materials and technology, a semiconductor memory, and a magnetic or solid-state storage device, in what is known as a Von Neumann architecture. Particularly, the processors in conventional computers are binary processors, i.e., operating on binary data represented in 1 and 0.

A quantum processor (q-processor) uses the odd nature of entangled qubit devices (compactly referred to herein as "qubit," plural "qubits") to perform computational tasks. In the particular realms where quantum mechanics operates, particles of matter can exist in multiple states—such as an "on" state, an "off" state, and both "on" and "off" states simultaneously. Where binary computing using semiconductor processors is limited to using just the on and off states (equivalent to 1 and 0 in binary code), a quantum processor harnesses these quantum states of matter to output signals that are usable in data computing.

Conventional computers encode information in bits. Each bit can take the value of 1 or 0. These 1s and 0s act as on/off switches that ultimately drive computer functions. Quantum computers, on the other hand, are based on qubits, which operate according to two key principles of quantum physics: superposition and entanglement. Superposition means that each qubit can represent both a 1 and a 0 at the same time. Entanglement means that qubits in a superposition can be correlated with each other in a non-classical way; that is, the state of one (whether it is a 1 or a 0 or both) can depend on the state of another, and that there is more information that can be ascertained about the two qubits when they are entangled than when they are treated individually.

Using these two principles, qubits operate as more sophisticated processors of information, enabling quantum computers to function in ways that allow them to solve difficult problems that are intractable using conventional computers. IBM has successfully constructed and demonstrated the operability of a quantum processor using superconducting qubits (IBM is a registered trademark of International Business Machines corporation in the United States and in other countries.)

A superconducting qubit includes a Josephson junction. A Josephson junction is formed by separating two thin-film superconducting metal layers by a non-superconducting material. When the metal in the superconducting layers is caused to become superconducting—e.g. by reducing the temperature of the metal to a specified cryogenic temperature—pairs of electrons can tunnel from one superconducting layer through the non-superconducting layer to the other superconducting layer. In a qubit, the Josephson junction—which functions as a dispersive nonlinear inductor—is electrically coupled in parallel with one or more capacitive devices forming a nonlinear microwave oscillator. The oscillator has a resonance/transition frequency determined by the value of the inductance and the capacitance in the qubit circuit. Any reference to the term "qubit" is a reference to a superconducting qubit circuitry that employs a Josephson junction, unless expressly distinguished where used.

The information processed by qubits is carried or transmitted in the form of microwave signals/photons in the range of microwave frequencies. The microwave signals are captured, processed, and analyzed to decipher the quantum information encoded therein. A readout circuit is a circuit coupled with the qubit to capture, read, and measure the quantum state of the qubit. An output of the readout circuit is information usable by a q-processor to perform computations.

A superconducting qubit has two quantum states—|0> and |1>. These two states may be two energy states of atoms, for example, the ground (|g>) and first excited state (|e>) of a superconducting artificial atom (superconducting qubit). Other examples include spin-up and spin-down of the nuclear or electronic spins, two positions of a crystalline defect, and two states of a quantum dot. Since the system is of a quantum nature, any combination of the two states are allowed and valid.

For quantum computing using qubits to be reliable, quantum circuits, e.g., the qubits themselves, the readout circuitry associated with the qubits, and other parts of the quantum processor, must not alter the energy states of the qubit, such as by injecting or dissipating energy, in any significant manner or influence the relative phase between the |0> and |1> states of the qubit. This operational constraint on any circuit that operates with quantum information necessitates special considerations in fabricating semiconductor and superconducting structures that are used in such circuits.

A quantum processor chip (QPC) can contain one or more qubits. A QPC can have one or more lines for microwave signal input or output. A common non-limiting embodiment of a microwave line is a coaxial cable carrying electromagnetic signal in the microwave frequency range.

Because presently available QPCs operate at ultra-low cryogenic temperatures, the lines, the readout circuits, and other peripheral components used in a quantum computing environment pass through one or more dilution refrigerator stage (compactly referred to herein as a "stage"). A stage operates to decrease the thermal state, or temperature, of lines and components entering at a high temperature side of the stage to the stage temperature—a temperature maintained at the stage. Thus, a series of stages progressively reduce the temperature of a line from room temperature (e.g., approximately 300 Kelvin (K)) to the cryogenic temperature at which the qubit operates, e.g., about 0.01 K.

A line from the final (lowest temperature) stage couples to the QPC. A signal from the qubit is conversely carried out on a line whose temperature progressively increases as the line passes through the series of stages in the direction away from the QPC. At each stage, including the final stage, the line has to connect to a semiconductor or superconductor circuit.

A stripline is a planar conductive structure in which a conducting material is formed in the shape of a strip inside a dielectric substrate and sandwiched between two ground planes. A ground plane is a structure—often a conductive metallic structure—at a ground potential. The strip forms a center conductor of the stripline. Although commonly the center conductor is formed in the forms of a substantially rectangular prism—having a substantially rectangular cross-section and a length—the illustrative embodiments contemplate other forms, such as cylindrical wires, also being formed and used as the center conductor in a stripline of an embodiment described herein.

Presently, a stripline is used to couple a microwave line to a circuit. Specifically, a presently used stripline is formed in a dielectric substrate insulator. A via structure is formed from the stripline to a conductive contact placed on an accessible surface of the substrate. The external circuit wire is then soldered to the contact.

The illustrative embodiments recognize that the presently striplines and the methods of forming them is not suitable for quantum applications for a variety of reasons. For example, most striplines that are fabricated in common dielectric substrates materials are usable only below 1 Gigahertz (GHz) and are not usable at cryogenic temperatures, particularly at temperatures below 4 K. Qubits operate at above 1 GHz and at temperatures far below 4 K. The striplines that are fabricated using superconducting materials can operate below 4 K and above 1 GHz but are poor thermal conductors and are not suitable for soldered connections to lines.

The illustrative embodiments recognize that for a stripline to be usable in a quantum computing environment, the stripline should thermalize well within the stage. Thermalization of one structure to another structure is the process of constructing and coupling the two structures in such a way that the coupling achieves at least a threshold level of thermal conductivity between the two structures. Good thermalization, i.e., thermalization where the thermal conductivity between the thermally coupled structure exceeds the threshold level of required thermal conductivity. For example, a thermal conductivity of greater than a 1 Watt/(centimeter*K) at 4 Kelvin, is an acceptable threshold level of good thermal conductivity according to the illustrative embodiments.

The illustrative embodiments recognize that a manner of coupling a microwave line to a circuit in a stage or to a qubit should exhibit good thermalization, good electrical conductivity (e.g., exhibit a Residual Resistance Ratio (RRR) of at least 100), and provide this electrical and thermal performance at cryogenic temperatures down to a millikelvin and lower, e.g., to 0.000001 K. Furthermore, the manner of coupling should be solder-free.

The illustrative embodiments recognize that presently formed striplines, when used for microwave applications cause a significant crosstalk between adjacent center conductors (CC, plural CCs) of the stripline. Because the quantum applications are dealing with levels of energy as small as a single photon, microwave interference from crosstalk and other noise must meet far more stringent requirements than in non-quantum applications. For example, for striplines to be usable in quantum applications, the crosstalk between CCs should be less than −50 decibels (dB). The illustrative embodiments recognize that in order to achieve less than −50 dB of crosstalk, the separation distance, or gap, between CCs in a stripline has to be undesirably large. The large separation between the CCs severely restrict the number of qubits and other quantum components that can be placed on a chip. The illustrative embodiments recognize that a higher density of CCs (small separation distance between CCs) without exceeding −50 dB of crosstalk would be desirable for quantum applications.

SUMMARY

The illustrative embodiments provide a stripline that is usable in a quantum application (q-stripline), and a method and system of fabrication therefor. A q-stripline of an embodiment includes a first polyimide film; a second polyimide film; a first center conductor and a second center conductor formed between the first polyimide film and the second polyimide film; and a first pin configured through the second polyimide film to make electrical and thermal contact with the first center conductor.

In one embodiment, a thickness of the first polyimide film is at least half of a specified insulator thickness B.

In another embodiment, B is selected such that three times the sum of a first dimension of the first center conductor and a separation distance between the first center conductor and the second conductor is greater than twice of thickness B to yield a microwave crosstalk of less than −50 decibels between the first center conductor and the second center conductor.

The q-stripline of another embodiment further includes a first recess in the second polyimide film, wherein the first recess is formed through a second ground plane and the second polyimide film to expose a portion of the first center conductor, and wherein the first pin is configured through the first recess.

The q-stripline of another embodiment further includes an elastic pin, wherein the elastic pin is used as the first pin, and wherein the elastic pin makes the electrical and thermal contact only by applying pressure on the first center conductor and without soldering.

The q-stripline of another embodiment further includes a connector, wherein the connector is configured to interface a microwave line with the first pin.

The q-stripline of another embodiment further includes a first ground plane on a first side of the first polyimide film, wherein the first center conductor and the second center conductor are formed on a side of the first polyimide film that is opposite the first side.

The q-stripline of another embodiment further includes a second ground plane on a first side of the second polyimide film, wherein the first center conductor and the second center conductor are formed on a side of the second polyimide film that is opposite the first side.

In another embodiment, the q-stripline operates at a cryogenic temperature of a dilution fridge stage (stage), wherein the q-stripline exhibits an above-threshold thermalization to the stage, wherein the q-stripline exhibits an above-threshold electrical conductivity at the cryogenic temperature of the stage, and wherein the q-stripline provides less than −50 decibels of microwave crosstalk between the first center conductor and the second center conductor.

An embodiment includes a fabrication method for fabricating the q-stripline.

An embodiment includes a fabrication system for fabricating the q-stripline.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of the illustrative embodiments when read in conjunction with the accompanying drawings, wherein:

DETAILED DESCRIPTION

Figure 1:
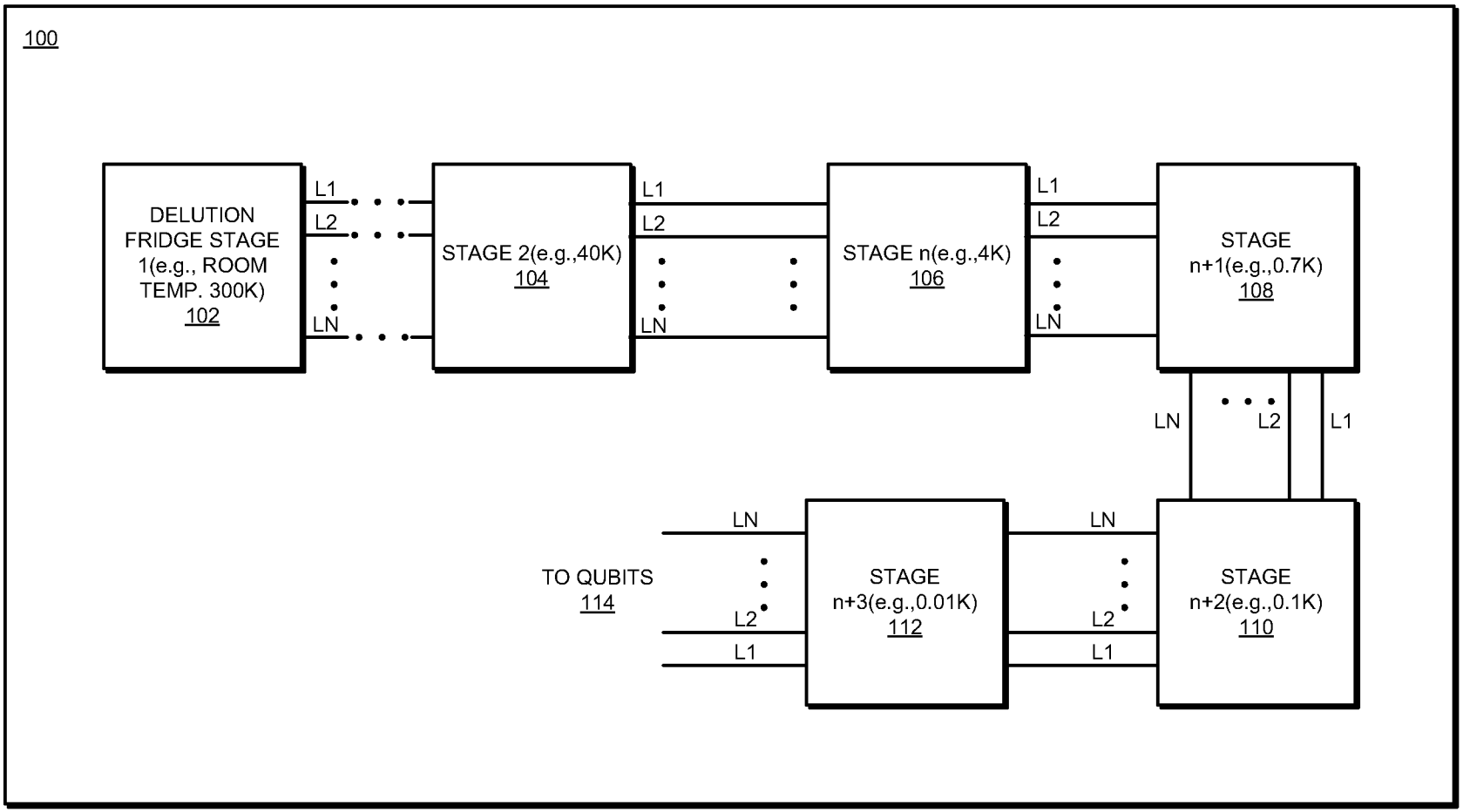
FIG. 1 depicts a block diagram of an example configuration of a series of stages in a quantum application where well thermalized q-stripline provide microwave connections in accordance with an illustrative embodiment.

The illustrative embodiments used to describe the invention generally address and solve the above-described needs for striplines that are particularly suited for the requirements of quantum applications (compactly referred to hereinafter as a q-stripline). The illustrative embodiments provide well-thermalized stripline formation for high-density connections in quantum applications.

An operation described herein as occurring with respect to a frequency of frequencies should be interpreted as occurring with respect to a signal of that frequency or frequencies. All references to a "signal" are references to a microwave signal unless expressly distinguished where used.

An embodiment provides a configuration of a q-stripline. Another embodiment provides a fabrication method for the q-stripline, such that the method can be implemented as a software application. The application implementing a fabrication method embodiment can be configured to operate in conjunction with an existing superconductor fabrication system—such as a lithography system.

For the clarity of the description, and without implying any limitation thereto, the illustrative embodiments are described using some example configurations. From this disclosure, those of ordinary skill in the art will be able to conceive many alterations, adaptations, and modifications of a described configuration for achieving a described purpose, and the same are contemplated within the scope of the illustrative embodiments.

Furthermore, simplified diagrams of the example q-stripline and its components are used in the figures and the illustrative embodiments. In an actual fabrication or circuit, additional structures or component that are not shown or described herein, or structures or components different from those shown but for the purpose described herein may be present without departing the scope of the illustrative embodiments.

Furthermore, the illustrative embodiments are described with respect to specific actual or hypothetical components only as examples. The steps described by the various illustrative embodiments can be adapted for fabricating a structure that can be purposed or repurposed to provide a described function of a q-stripline, and such adaptations are contemplated within the scope of the illustrative embodiments.

The illustrative embodiments are described with respect to certain types of materials, electrical properties, steps, shapes, sizes, numerosity, frequencies, circuits, components, and applications only as examples. Any specific manifestations of these and other similar artifacts are not intended to be limiting to the invention. Any suitable manifestation of these and other similar artifacts can be selected within the scope of the illustrative embodiments.

The examples in this disclosure are used only for the clarity of the description and are not limiting to the illustrative embodiments. Any advantages listed herein are only examples and are not intended to be limiting to the illustrative embodiments. Additional or different advantages may be realized by specific illustrative embodiments. Furthermore, a particular illustrative embodiment may have some, all, or none of the advantages listed above.

With reference to FIG. 1, this figure depicts a block diagram of an example configuration of a series of stages in a quantum application where well thermalized q-stripline provide microwave connections in accordance with an illustrative embodiment. Stages 102, 104, 106, 108, 110, and 112 are some example dilution fridge stages, each maintaining a specified temperature, as described herein. For example, stage 102 may be at room temperature of approximately 300 K, and so on, with base stages 104-112 maintaining 40 K, 4 K, 0.7 K, 0.1 K, 0.01 K, respectively.

Lines L1, L2 . . . Ln carry microwave signals and pass through stages 102-112 towards qubit 114 or from qubit 114.

Figure 2:
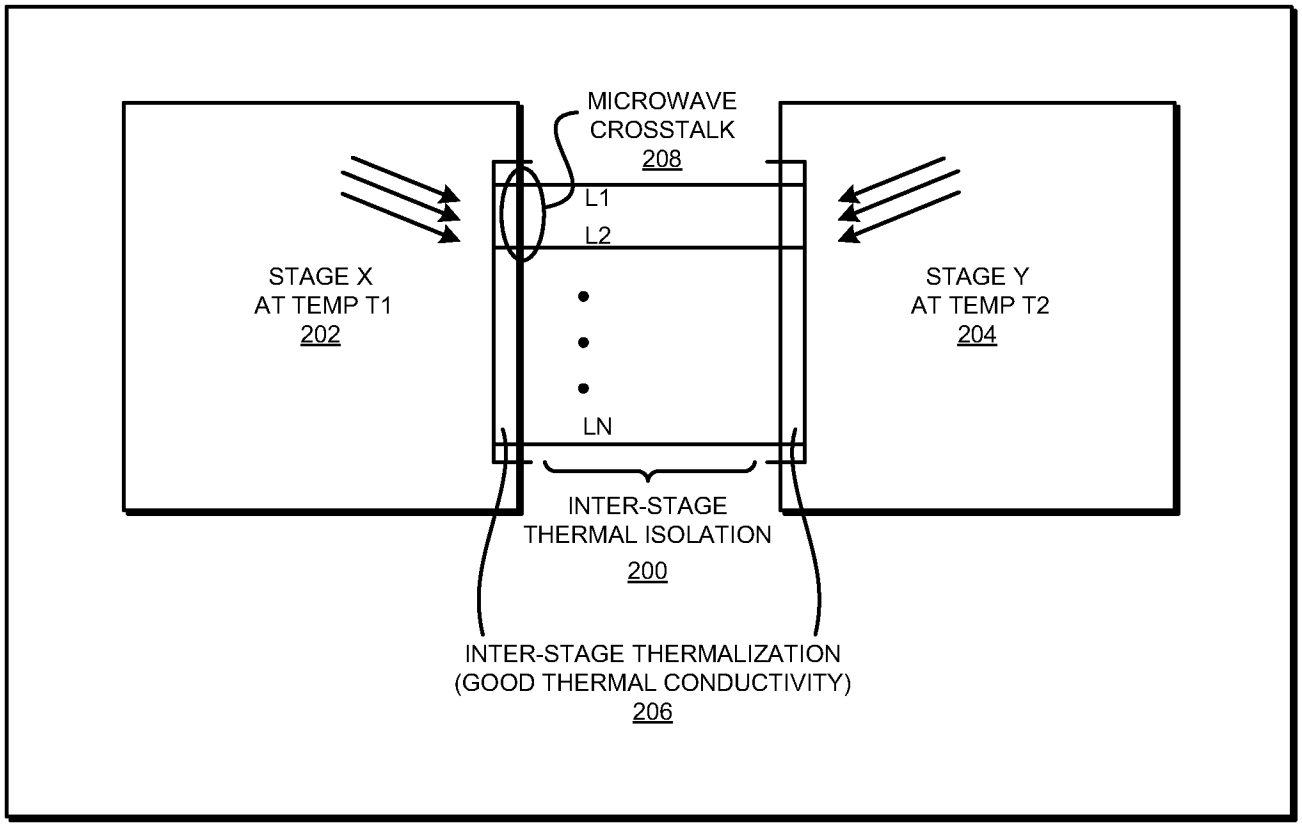
FIG. 2 depicts connections of lines within a stage which can be improved using q-striplines in accordance with an illustrative embodiment.

With reference to FIG. 2, this figure depicts connections of lines within a stage which can be improved using q-striplines in accordance with an illustrative embodiment. Stages 202 and 204 are examples of two consecutive stages in a series of stages, e.g., stages 104 and 106, or stages 106 and 108, or stages 108 and 110, or stages 110 and 112 in FIG. 1. Suppose that stage 202 is stage X maintaining temperature T1 and stage 204 is stage Y maintaining temperature T2 therein. Stages 202 and 204 are coupled via two or more lines L1 . . . Ln in the manner of FIG. 1.

When the lines enter a stage, the lines should be well thermalized with the stage. Connection area 206 in each of stages 202 and 204 is such an area, and connection area 206 is where the lines couple with a component of a quantum apparatus in a given stage. The potential for microwave crosstalk 208 exists between adjacent lines and connection points in area 206. Presently, prior-art striplines in connection area 206 cause undesirable level of crosstalk and poor thermalization for the reasons described herein. A q-stripline in connection area 206 improves thermalization of the lines and connectors to a stage, and also facilitates higher density of connections as compared to the prior-art striplines without causing the crosstalk to exceed −50 dB.

Figure 3:
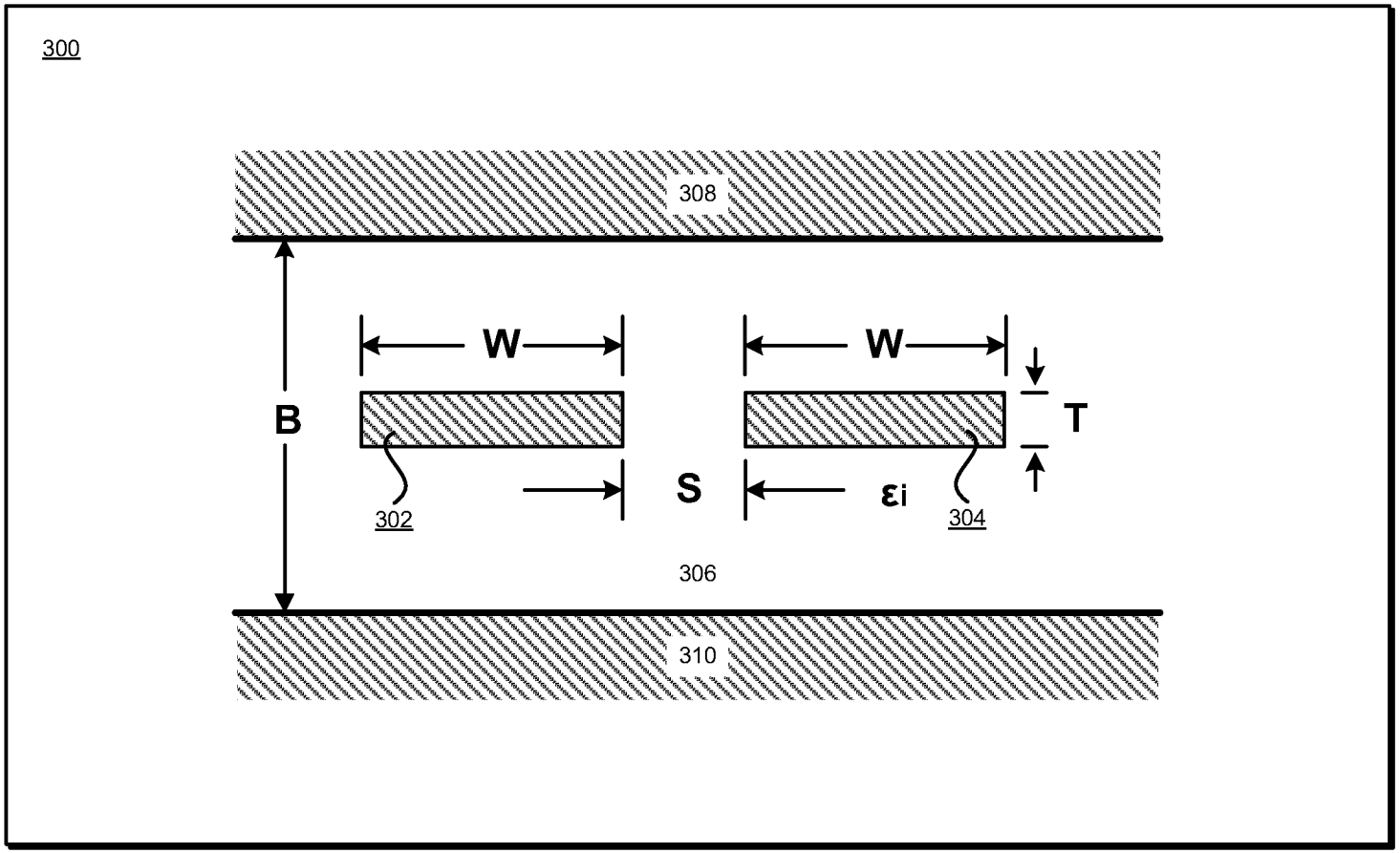
FIG. 3 depicts a block diagram of a configuration of a q-stripline in accordance with an illustrative embodiment.

With reference to FIG. 3, this figure depicts a block diagram of a configuration of a q-stripline in accordance with an illustrative embodiment. Configuration 300 depicts two CCs 302 and 304 in an insulator, e.g., substrate 306, and sandwiched between ground planes 308 and 310. The materials used for CCs 302 and 304 and ground planes 308 and 310 can be, but need not be, the same.

In the non-limiting depiction of this figure, CCs 302 and 304 have widths W, thickness T and are separated from each other by separation distance S. B is the total thickness of substrate 306, in which CCs 302 and 304 are substantially centered. In one embodiment, the separation distance S between CCs 302 and 304 is a function of a dimension of CCs 302, 304, or both. For example, when CCs 302 and 304 have a rectangular profile as shown in this non-limiting example, S is a function of dimension T, the thickness of CCs 302 and/or 304. In another embodiment, e.g., when CCs 302 and/or 304 have similar profiles but of a different shape, such as in the case of cylindrical CCs, S would be a function of the radius of one or both cylinders.

In one embodiment, e.g., in the case of forming a q-stripline using the depicted rectangular profile, when the W, S, and B are configured according to the following condition, the crosstalk in CCs 302 and 304 is desirably limited to below −50 dB—

$$3(W+S)>2*B$$

Figure 4:
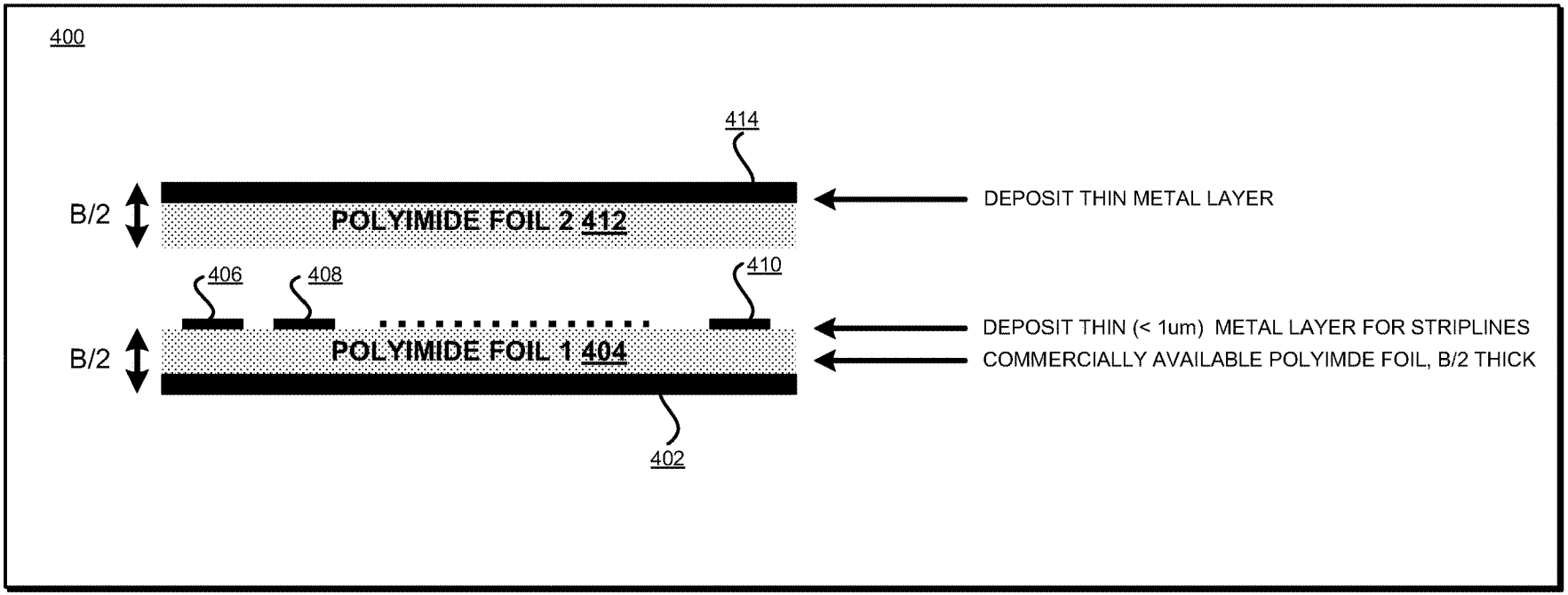
FIG. 4 depicts a configuration of a q-stripline, and a method for forming the q-stripline in accordance with an illustrative embodiment.

With reference to FIG. 4, this figure depicts a configuration of a q-stripline, and a method for forming the q-stripline in accordance with an illustrative embodiment. Configuration 400 is a specific example of configuration 300. Configuration 400 can be used in connection area 206 in FIG. 2 to achieve high-density connections with acceptable crosstalk and thermalization. Metal layer 402 forms a first ground plane. Layer 404 of polyimide having at least half the thickness B as described with respect to FIG. 3, is deposited over ground plane 402. In one embodiment, a commercially available polyimide film of thickness at least B/2 can be used as structure 404.

A suitable thin metal deposition technique is used by an embodiment to deposit CCs 406, 408 . . . 410 to form any number of CCs of stripline 400. In one embodiment, the CCs are formed with approximately a rectangular profile having a thickness T of less than 1 micrometer.

An embodiment deposits layer 412 of polyimide having at least half the thickness B as described with respect to FIG. 3, over CCs 406 . . . 410. The embodiment deposits metal layer 414 over polyimide film 412 to form a second ground plane, thus completing the stripline structure of q-stripline 400.

Figure 5:
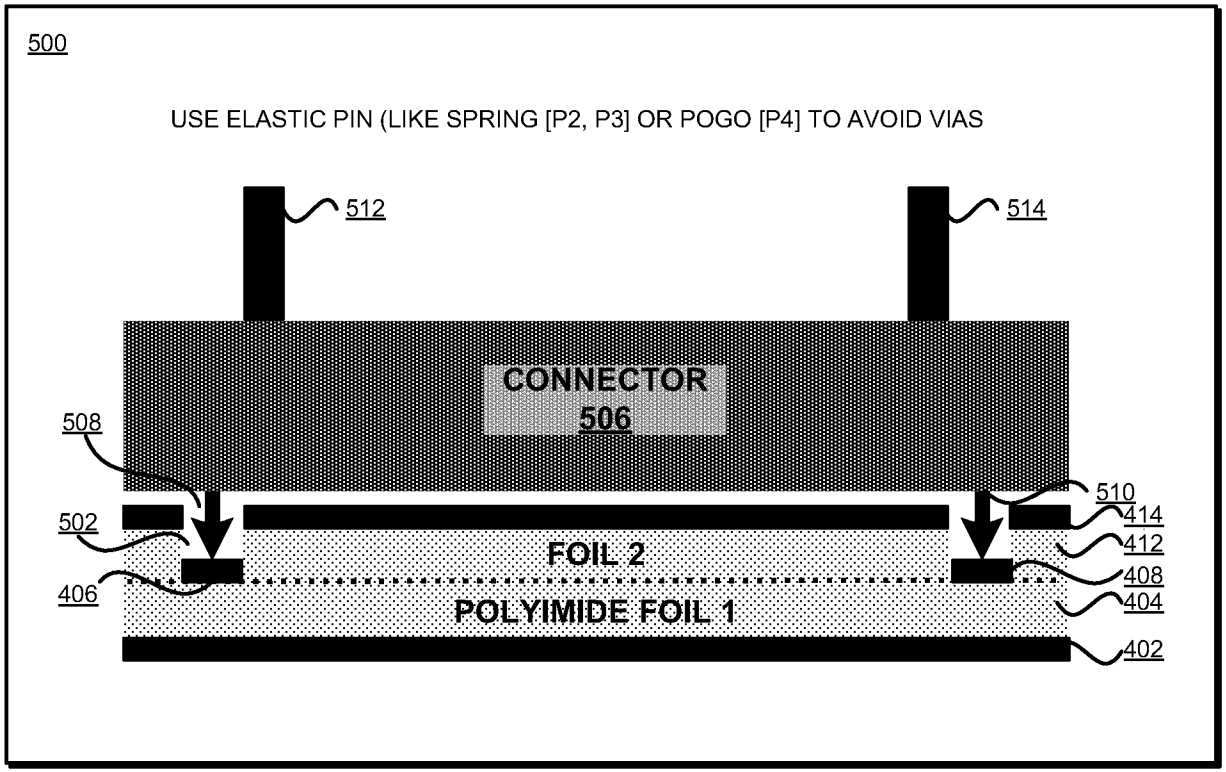
FIG. 5 depicts a block diagram and a method for connecting microwave lines to a q-stripline in accordance with an illustrative embodiment.

With reference to FIG. 5, this figure depicts a block diagram and a method for connecting microwave lines to a q-stripline in accordance with an illustrative embodiment. Structure 400 is subjected to further steps in configuration 500 for connecting with microwave lines.

An embodiment etches or recesses hole 502 to expose a portion of CC 406. The embodiment may, optionally, form additional holes to expose portions of other CCs in q-stripline configuration 500, e.g., hole 504 to expose a portion of CC 408. The portions of CCs exposed in this manner become available for electrical and thermal connection with other components. For example, connector 506 may be a commercially available cable connector or a custom-made connector depending on the type of cables and the application in which it is used. An embodiment configures connector 506 with pin 508, which passes through hole 502 to form an electrical and thermal connection with CC 406. Similarly, the embodiment is operable to configure any number of additional pins for additional exposed portions of additional CCs, such as pin 510 to contact CC 408 through hole 504. In one embodiment, pins 508 and 510 are elastic pins, which are capable of forming the electrical and thermal connection between lines 512-514 and CCs 406-408 without soldering.

Connector 506 is selected according to the type of cables 512 and 514, which form lines L1, L2, and so on, as depicted in FIGS. 1 and 2. In one embodiment, lines 512 and 514 are formed using coaxial cables.

Figure 6:
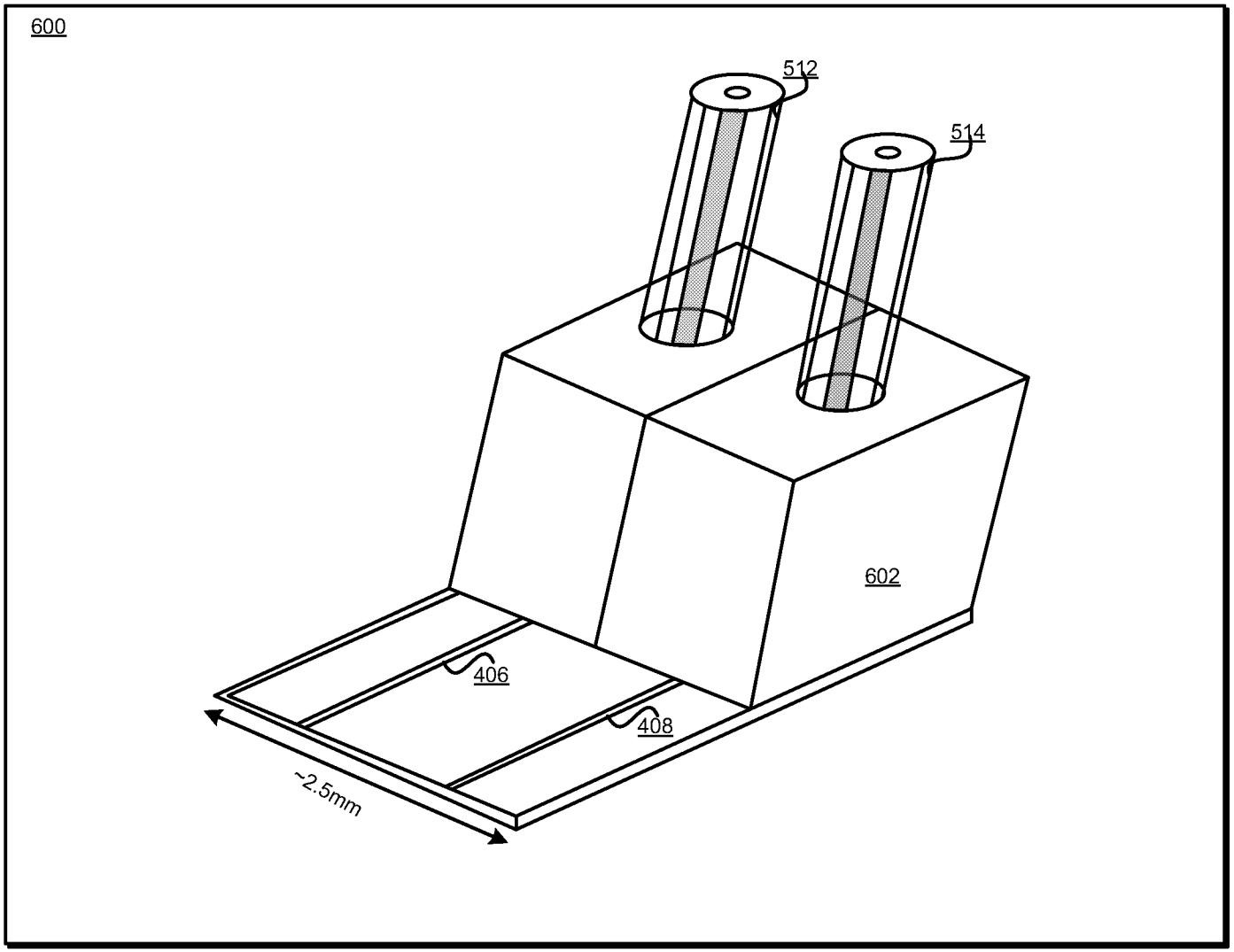
FIG. 6 depicts a schematic of an example connector usable with a q-stripline in accordance with an illustrative embodiment.

With reference to FIG. 6, this figure depicts a schematic of an example connector usable with a q-stripline in accordance with an illustrative embodiment. Connector 602 is usable as connector 506 in FIG. 5. Connector 602 receives lines 512 and 514. Connector 602 houses pins 508-510 (not visible in this figure), which establish electrical and thermal connectivity between lines 512-514 and CCs 406-408, respectively. The connection formed in this manner between lines 512-514 and CCs 406-408 exhibits good thermalization relative to the thresholds described herein, electrical conductivity for electromagnetic signals in quantum applications, at cryogenic temperatures described herein, with a density (e.g., 2.5 millimeter separation distance S) that is higher than the prior-art stripline density for quantum applications, while producing microwave crosstalk below the threshold for quantum applications.

Figure 7:
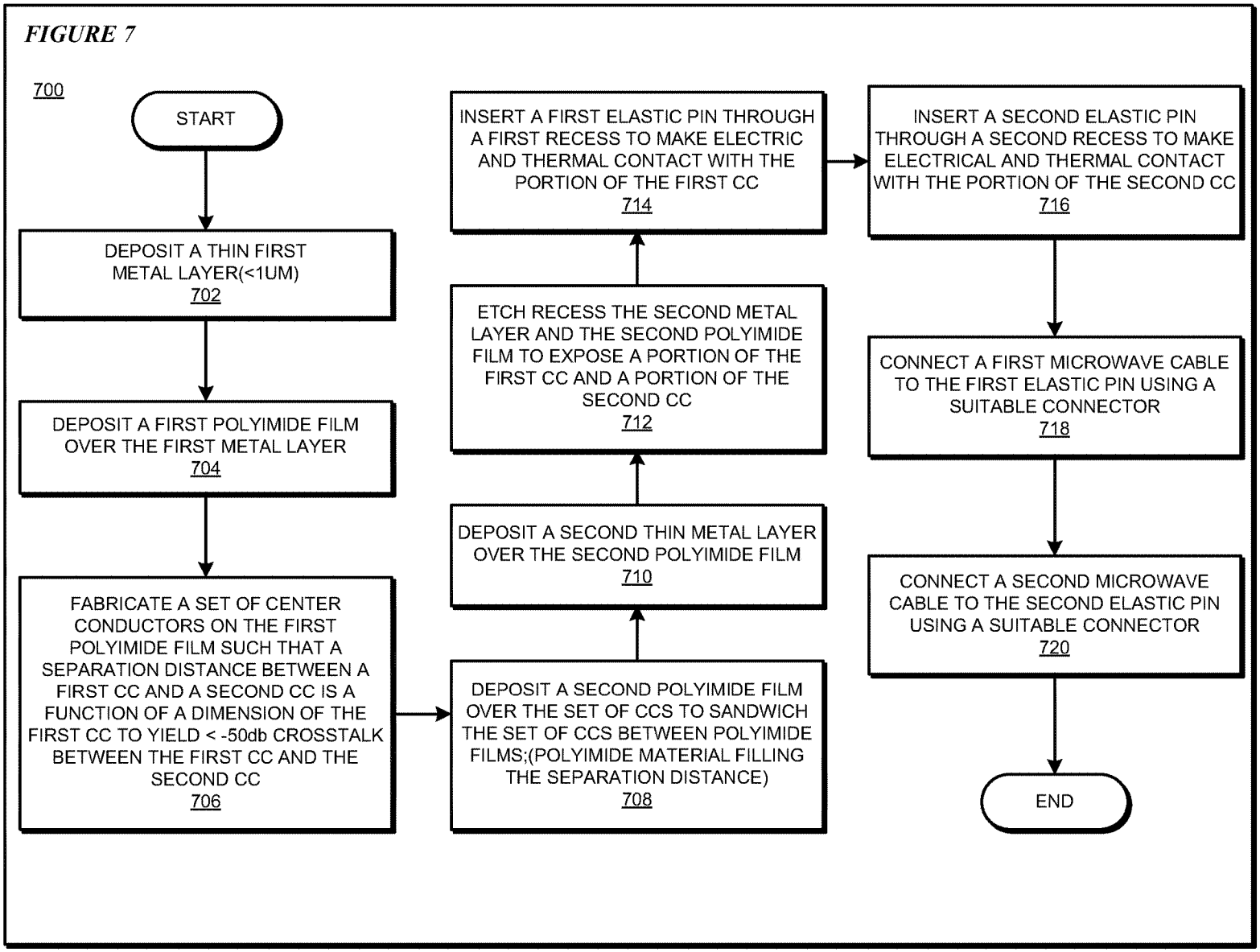
FIG. 7 depicts a flowchart of an example process for fabricating a q-stripline in accordance with an illustrative embodiment.

With reference to FIG. 7, this figure depicts a flowchart of an example process for fabricating a q-stripline in accordance with an illustrative embodiment. Process 700 of an embodiment can be implemented in a software application to operate a semiconductor or superconductor fabrication apparatus, or in a fabrication system that operates to fabricate semiconductor or superconductor devices.

Process 700 deposits a first metal layer to form a first ground plane (block 702). The ground plane can be formed using a superconducting material in one embodiment.

Process 700 deposits a first polyimide film of at least B/2 thickness over the first ground plane (block 704). Process 700 fabricates a set of center conductors on the first polyimide film using a separation distance according to a function described herein (block 706).

Process 700 deposits a second polyimide film of at least B/2 thickness over the set of CCs (block 708). Process 700 deposits a second thin metal layer over the second polyimide film to form the second ground plane (block 710).

Process 700 etches or recesses the second ground plane and the second polyimide film to expose a portion of a CC (block 712). Process 700 similarly creates as many recesses as needed to expose portions of various CCs in the set. Process 700 causes a first pin of a connector to extend through a first recess and make electrical and thermal contact with an exposed portion of a first CC (block 714). Process 700 causes a second pin of the connector to extend through a second recess and make electrical and thermal contact with an exposed portion of a second CC (block 716).

Process 700 causes a first microwave line to be coupled with the first pin via the connector (block 718). Process 700 causes a v microwave line to be coupled with the v pin via the connector (block 720). Process 700 ends thereafter.

A substrate contemplated within the scope of the illustrative embodiments can be formed using any suitable substrate material, such as, for example, monocrystalline Silicon (Si), Silicon-Germanium (SiGe), Silicon-Carbon (SiC), compound semiconductors obtained by combining group III elements from the periodic table (e.g., Al, Ga, In) with group V elements from the periodic table (e.g., N, P, As, Sb) (III-V compound semiconductor), compounds obtained by combining a metal from either group 2 or 12 of the periodic table and a nonmetal from group 16 (the chalcogens, formerly called group VI) (II-VI compound semiconductor), or semiconductor-on-insulator (SOI). In some embodiments of the invention, the substrate includes a buried oxide layer (not depicted).

The conductor can comprise any suitable conducting material, including but not limited to, a metal (e.g., tungsten (W), titanium (Ti), tantalum (Ta), ruthenium (Ru), hafnium (Hf), zirconium (Zr), cobalt (Co), nickel (Ni), copper (Cu), aluminum (Al), platinum (Pt), tin (Sn), silver (Ag), gold (Au), a conducting metallic compound material (e.g., tantalum nitride (TaN), titanium nitride (TiN), tantalum carbide (TaC), titanium carbide (TiC), titanium aluminum carbide (TiAlC), tungsten silicide (WSi), tungsten nitride (WN), ruthenium oxide ($RuO_2$), cobalt silicide (CoSi), nickel silicide (NiSi)), transition metal aluminides (e.g. $Ti_3Al$, ZrAl), TaC, TaMgC, carbon nanotube, conductive carbon, graphene, or any suitable combination of these materials. The conductive material may further comprise dopants that are incorporated during or after deposition.

Examples of superconducting materials (at low temperatures, such as about 10-100 millikelvin (mK), or about 4 K) include Niobium, Aluminum, Tantalum, etc. The lines can be made of a superconducting material.

Various embodiments of the present invention are described herein with reference to the related drawings. Alternative embodiments can be devised without departing from the scope of this invention. Although various connections and positional relationships (e.g., over, below, adjacent, etc.) are set forth between elements in the following description and in the drawings, persons skilled in the art will recognize that many of the positional relationships described herein are orientation-independent when the described functionality is maintained even though the orientation is changed. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "illustrative" is used herein to mean "serving as an example, instance or illustration." Any embodiment or design described herein as "illustrative" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A stripline that is usable in a quantum application (q-stripline) comprising:

a first polyimide film;

a second polyimide film;

a first center conductor and a second center conductor formed between the first polyimide film and the second polyimide film; and a first pin configured through the second polyimide film to make electrical and thermal contact with the first center conductor, wherein the q-stripline is configured to provide less than −50 decibels of microwave crosstalk between the first center conductor and the second center conductor.

2. The q-stripline of claim 1, wherein a thickness of the first polyimide film is at least half of a specified insulator thickness B.

3. The q-stripline of claim 2, wherein the insulator thickness B is selected such that three times a sum of a first dimension of the first center conductor and a separation distance between the first center conductor and the second conductor is greater than twice of the insulator thickness B to yield the microwave crosstalk of less than −50 decibels between the first center conductor and the second center conductor.

4. The q-stripline of claim 1, further comprising:

a first recess in the second polyimide film, wherein the first recess is formed through a second ground plane and the second polyimide film to expose a portion of the first center conductor, and wherein the first pin is configured through the first recess.

5. The q-stripline of claim 1, further comprising:

an elastic pin, wherein the elastic pin is used as the first pin, and wherein the elastic pin makes the electrical and thermal contact only by applying pressure on the first center conductor and without soldering.

6. The q-stripline of claim 1, further comprising:

a connector, wherein the connector is configured to interface a microwave line with the first pin.

7. The q-stripline of claim 1, further comprising:

a first ground plane on a first side of the first polyimide film, wherein the first center conductor and the second center conductor are formed on a side of the first polyimide film that is opposite the first side.

8. The q-stripline of claim 7, further comprising:

a second ground plane on a first side of the second polyimide film, wherein the first center conductor and the second center conductor are formed on a side of the second polyimide film that is opposite the first side.

9. The q-stripline of claim 1, wherein the q-stripline operates at a cryogenic temperature of a dilution fridge stage (stage), wherein the q-stripline exhibits an above-threshold thermalization to the stage, and wherein the q-stripline exhibits an above-threshold electrical conductivity at the cryogenic temperature of the stage.

10. A method to fabricate a stripline that is usable in a quantum application (q-stripline), comprising:

forming a first polyimide film;

forming a second polyimide film;

forming a first center conductor and a second center conductor between the first polyimide film and the second polyimide film; and configuring a first pin through the second polyimide film to make electrical and thermal contact with the first center conductor, wherein the q-stripline is configured to provide less than −50 decibels of microwave crosstalk between the first center conductor and the second center conductor.

11. The method of claim 10, wherein a thickness of the first polyimide film is at least half of a specified insulator thickness B.

12. The method of claim 11, wherein the insulator thickness B is selected such that three times a sum of a first dimension of the first center conductor and a separation distance between the first center conductor and the second conductor is greater than twice of the insulator thickness B to yield the microwave crosstalk of less than −50 decibels between the first center conductor and the second center conductor.

13. The method of claim 10, further comprising:

forming a first recess in the second polyimide film, wherein the first recess is formed through a second ground plane and the second polyimide film to expose a portion of the first center conductor, and wherein the first pin is configured through the first recess.

14. The method of claim 10, further comprising:

configuring an elastic pin, wherein the elastic pin is used as the first pin, and wherein the elastic pin makes the electrical and thermal contact only by applying pressure on the first center conductor and without soldering.

15. The method of claim 10, further comprising:

configuring a connector to interface a microwave line with the first pin.

16. The method of claim 10, further comprising:

forming a first ground plane on a first side of the first polyimide film, wherein the first center conductor and the second center conductor are formed on a side of the first polyimide film that is opposite the first side.

17. The method of claim 16, further comprising:

forming a second ground plane on a first side of the second polyimide film, wherein the first center conductor and the second center conductor are formed on a side of the second polyimide film that is opposite the first side.

18. The method of claim 10, wherein the q-stripline operates at a cryogenic temperature of a dilution fridge stage (stage), wherein the q-stripline exhibits an above-threshold thermalization to the stage, and wherein the q-stripline exhibits an above-threshold electrical conductivity at the cryogenic temperature of the stage.

19. A fabrication system which when operated to fabricate a stripline that is usable in a quantum application (q-stripline) performs operations comprising:

forming a first polyimide film;

forming a second polyimide film;

forming a first center conductor and a second center conductor between the first polyimide film and the second polyimide film; and configuring a first pin through the second polyimide film to make electrical and thermal contact with the first center conductor, wherein the q-stripline is configured to provide less than −50 decibels of microwave crosstalk between the first center conductor and the second center conductor.

20. The fabrication system of claim 19, wherein a thickness of the first polyimide film is at least half of a specified insulator thickness B.

* * * * *